US005992451A

United States Patent [19]

Chang

[11] Patent Number: 5,992,451

[45] Date of Patent: Nov. 30, 1999

[54] REED VALVE FOR POOL CLEANER

[76] Inventor: Paul C. Chang, 2473 San Saba St., Tustin, Calif. 92782

[21] Appl. No.: 09/037,273

[22] Filed: Mar. 9, 1998

[51] Int. Cl.[6] ..... E04H 4/16; F16K 15/14

[52] U.S. Cl. ..... 137/521; 15/1.7; 137/518; 137/624.14

[58] Field of Search ..... 137/518, 521, 137/624.14, 624.18, 855, 857; 15/1.7

[56] References Cited

U.S. PATENT DOCUMENTS

| | | | |
|---|---|---|---|
| 594,727 | 11/1897 | Cooper | 137/521 X |
| 2,293,956 | 8/1942 | Walthers | 137/518 |
| 3,304,564 | 2/1967 | Green et al. | 15/1.7 |
| 3,776,464 | 12/1973 | Proffit | 15/1.7 X |
| 4,023,227 | 5/1977 | Chauvier . | |
| 4,228,770 | 10/1980 | Boyesen | 137/855 X |
| 4,351,077 | 9/1982 | Hoffmann . | |
| 4,742,593 | 5/1988 | Kallenbach | 15/1.7 |
| 4,769,867 | 9/1988 | Stoltz . | |
| 4,807,318 | 2/1989 | Kallenbach . | |
| 4,817,225 | 4/1989 | Stoltz . | |
| 4,836,151 | 6/1989 | Litjens et al. | 137/855 X |
| 5,033,148 | 7/1991 | Chauvier et al. . | |
| 5,265,297 | 11/1993 | Gould et al. . | |
| 5,301,380 | 4/1994 | Wadman et al. | 15/1.7 |
| 5,320,504 | 6/1994 | Lundback | 137/855 X |
| 5,337,433 | 8/1994 | Gould et al. . | |
| 5,384,928 | 1/1995 | Khoury . | |
| 5,440,645 | 8/1995 | Atkins . | |
| 5,592,966 | 1/1997 | Gates | 137/518 X |
| 5,604,950 | 2/1997 | Stern . | |
| 5,634,229 | 6/1997 | Stoltz . | |
| 5,655,246 | 8/1997 | Chang . | |

*Primary Examiner*—John Rivell
*Assistant Examiner*—Meredith H. Schoenfeld
*Attorney, Agent, or Firm*—Gordon K. Anderson

[57] ABSTRACT

An improved valve for a pulsating submergible pool cleaner having a valve body (20) with an integral relief valve (32). The valve is dual acting and utilizes a pair of opposed laminated valve plates (50) with an outward bend (52) on one end and a right angle bend (54) on the other. When negative pressure is applied to the opposed plates, each plate draws together over a fulcrum (26) until the right angle bend touches a restrictive boundary in a cage (28) integral with the body creating the first step in the dual action. When negative pressure continues, the valve plates arcuately bow until the outward bends contiguously abut, closing the valve to fluid flow and creating the final step in the dual action. A garter spring (60) pulls the valves plates into their original parallel position when pressure is relieved.

19 Claims, 3 Drawing Sheets

REED VALVE FOR POOL CLEANER

TECHNICAL FIELD

This invention relates to improvements in valves for pool cleaners in general. More specifically to a dual acting reed valve for a submersible pulsating pool cleaner.

BACKGROUND ART

Previously, many types of valves have been used in endeavoring to provide an effective means for producing the pulsating effect for submersible pool cleaners using the suction of a pool pump for interruptingly drawing water and debris from a swimming pool. Many different valves have been used in the past to create the desired pulsating action including, not only reed valves, but flappers, flexible diaphragms, flexible jaws, bellows, ball valves and elastomeric jaws.

A search of the prior art did not disclose any patents that read directly on the claims of the instant invention, however the following U.S. patents are considered related:

| U.S. Pat. No. | Inventor | Issue Date |
|---|---|---|
| 4,023,227 | Chauvier | May 17, 1977 |
| 4,351,077 | Hofmann | Sep. 28, 1982 |
| 4,769,867 | Stoltz | Sep. 13, 1988 |
| 4,807,318 | Kallenbach | Feb. 28, 1989 |
| 4,817,225 | Stoltz | Apr. 4, 1989 |
| 5,033,148 | Chauvier et al | Jul. 23, 1991 |
| 5,265,297 | Gould et al | Nov. 30, 1993 |
| 5,337,433 | Gould et al | Aug. 16, 1994 |
| 5,384,928 | Khoury | Jan. 31, 1995 |
| 5,440,645 | Atkins | Sep. 19, 1995 |
| 5,604,950 | Stern | Feb. 25, 1997 |
| 5,634,229 | Stolz | Jun. 3, 1997 |
| 5,655,246 | Chang | Aug. 12, 1997 |

U.S. Pat. Nos. 4,023,227, 4,351,077, and 5,033,148 disclose a flapper valve that is pivotally displaced to automatically transfer flow from one passage to another. In some cases a bypass valve is required to regulate the suction pressure applied to the apparatus and in U.S. Pat. No. 5,033,148 an auxiliary inlet is utilized to accommodate the volume of fluid flow through the pool pump.

A flexible diaphragm valve is utilized in U.S. Pat. No. 5,450,645, issued to Atkins, which consists of a resilient tube that is reduced in area in the middle, with ribs for controlling it's flexibility. The diaphragm is closed due to the negative pressure of the pump overcoming the resistance of the flexural walls pulling the walls together to impede the flow. Pressure equalization on the outside of the diaphragm permits opening, and the preferred method employed to accomplish this function is spring loading.

U.S. Pat. Nos. 4,769,867, 5,265,297, 5,384,928 and 5,634,229 disclose a valve having jaw-like lips of a flexible material biased in an open position by it's inherent elasticity and resiliency. The lips close under negative pressure and reopen by the material establishing it's inherent memory.

Kallenbach in U.S. Pat. No. 4,807,318 employs a spring loaded bellows-like diaphragm and a rigid unrestricted outlet passageway for flow interruption and cycling.

U.S. Pat. No. 4,817,225 of Stoltz teaches a spherical closure member having a specific gravity slightly greater than the liquid causes interruption by moving freely toward and away from the valve seat.

Gould et al, in U.S. Pat. No. 5,337,433, teach a valve having an entrance mouth with one of more single acting closure lips formed of thin metal spring material. The lips are drawn into full closure by the suction of the pool pump and open when the bias is substantially less than the closing force. No bumpers, weights, nets, or floats are used to assist in balance efficiency. Partial flow of the pump is utilized in the apparatus at a specific design flow rate.

Sterns U.S. Pat. No. 5,604,950 discloses a suction cleaning device with a longitudinal throat split into discrete portions. One portion is movable relative to the others, permitting expansion to pass large foreign objects through the throat.

U.S. Pat. No. 5,655,246 issued to Chang is my prior art upon which the improvement in the valve itself is based. Previously, the reed valve consisted of a pair of opposed deflecting reeds, each having a fixed reed and a movable reed. The fixed reed was connected to the body on one end with a stud, and the other secured to the movable reed through an elongated slot. The spring action of the combination created a double action movement flexing the reeds into a bow shape simultaneously by virtue of their combined spring action. The flow of water is impeded by the reed valve due to the shock wave or water hammer when the opposed movable reeds are drawn together at their distal ends.

DISCLOSURE OF THE INVENTION

Constant operation of my prior art reed valve subjected the movable reed to considerable, stress resulting in subsequent fatigue of the metal itself. In normal operation, in above freezing climates, the cleaner may operate an average of 4 hours per day. The reeds pulse, or converge, and touch the distal ends some 8 times per second, which equates to 42,048,000 occurrences per year. This action obviously places an intense demand on the metals flexural strength. Further, the extreme ends of the reeds intimately touch together, as the unsupported ends are exposed to negative pressure from the pool pump. Since the two movable reeds are positioned in parallel alignment, the pump suction causes them to contiguously abut, however, while the fixed reed is securely attached on one end, the movable reed is only connected to the fixed reed through a slot permitting the double acting movement, therefore precise and repeatable alignment is not always possible, nor required for function. While the valve in the prior art pool cleaner functions impeccably, the distal ends do not always meet at the exact center, sometimes overlapping on one side or the other. This is evident by scratch or wear marks on each reed indicating this operational behavior. In time the metal fatigues and yields with a resultant crack and eventual break, which may end in total failure of the device, or at the very least, a decrease in efficiency.

It is, therefore, a primary object of the invention to improve the life and durability of the reed valve without detracting from the operational characteristics of the prior art pool cleaner or similar cleaners employing reed valves for full or partial flow operation. The improvement simplifies the valve in its configuration by utilizing a pair of opposed single metallic reeds with the distal end bent outwardly such that when the ends converge, they do not engage together on a single knife edge, instead the two bent portions are fully contiguous, creating a infinally larger surface and eliminate the possibility of overlapping on one side or the other. Further, since the bent portions are liberally sized, alignment is no longer critical and tolerances are greatly increased, such that it is virtually impossible to have misalignment when the valves flex and meet together.

An important object of the invention is in the construction of the single reed, as when the pool pump has a low flow, such as under 20 gallons (75.7 liters) per minute, it requires a reed with low elastic plasticity, while a high flow rate, say above 60 to 80 gallons (227 to 303 liters) per minute, requires much higher modules of elasticity to govern the closure rate. It is asserted that no single material is presently available having such a wide range of requirements, or will automatically change it's characteristics under the parameters of the application. It has been found, however, that using laminated multiple thickness of discrete sheet segments of metal attached at only one end are versatile enough to function satisfactorily in both the high and low flow rates found in conventional pool cleaners. The valve reeds are joined together only at the outward bend, preferably by laser welding, or resistance seam welding. This arrangement of multiple sheets of metal, preferably stainless steel, permit the reed to bow inwardly at the appropriate time intervals and flow rates extending the life of the entire valve to an acceptable level.

Another object of the invention includes a dual action function of the valve in that each reed is not attached firmly at one end, instead they are held in place by a garter spring. As the reeds begin pulling together at this distal end against the fulcrum in the valve body, the opposite end of the reeds expand outwardly until the garter spring is contained by the valve body. This initial movement partially closes the valve without bending the reeds and, therefore acts as a first step in the dual action. The second step in this dual action actually bends the reeds upwardly towards each other until they touch on the bent portions, momentarily shutting off the flow of water through the valve. It will be seen that this operational capability reduces the bending moment to almost half of its total span, at least in the geometry of the embodiment, illustrated in the drawings. This reduction in angular displacement of the reed greatly improves the longevity of its life span and lengthens the overall utility of the pool cleaner in which it is applied.

Still another object of the invention is directed to the utilization of adjustment in the positioning of the garter spring relative to the fulcrum. The invention includes a series of grooves that hold the garter spring in place, which allow easy adjustment by simply repositioning the spring in the appropriate groove for the optimum flow characteristics. As pool cleaners must operate with different pool pumps and fluid resistance in hose length, piping, etc., it is advantageous to include some method of adjustment for various flow rates. The invention is simple to adjust by removing the valve body from the cleaner and move the spring to a new set of grooves or channels, then replacing the valve assembly in the cleaner. This basic fine tuning of the flow regulation expands the valves utility to operate satisfactorily in a wide range of pool cleaner applications.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
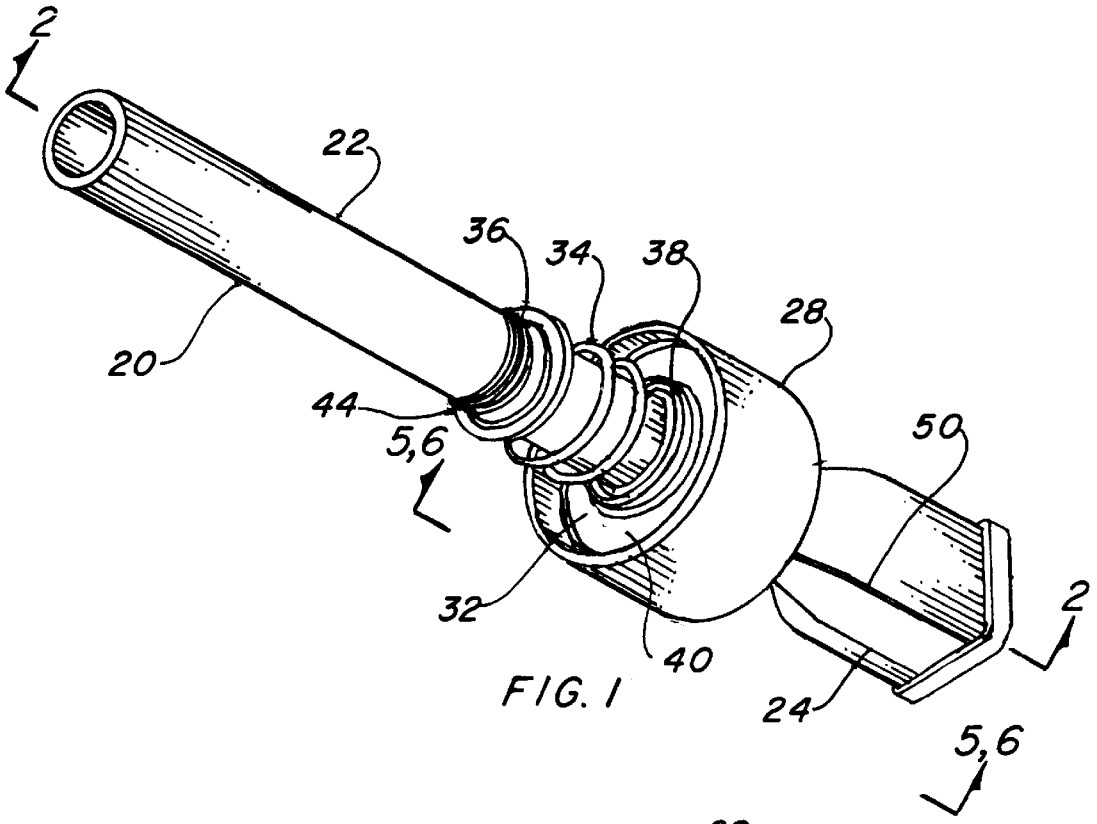
FIG. 1 is a partial isometric view of the preferred embodiment.

The best mode for carrying out the invention is presented in terms of a preferred embodiment.

The preferred embodiment, as shown in FIGS. 1 through 16, is comprised of a valve body 20 forming an enclosure for the reed valve 22. This body 20 is illustrated best in FIGS. 1 through 6 and is preferably constructed of a thermoplastic material, such as polycarbonate, polyethylene, polyvinyl chloride, polystyrene, polyurethane ABS, phenolic, or the like. Construction techniques prefer injection molding of the body and peripheral parts. The body 20 incorporates a pair of rectangular openings 24 for receiving valve plates with one edge acting as a fulcrum 26 upon which the valve plate is bent. It should be recognized that the reed valve 22 is basically an improvement on my prior U.S. Pat. No. 5,655,246, therefore the configuration of the body 20 is shown conforming to its functional requirements, including essentially the same relief valve portion consisting of a cage 28, a retainer 30, a relief valve 32, valve compression spring 34, spring keeper 36, valve seal disc bushing 38, and seal disc 40. In function, the combined valve assembly is the full flow type, including the integral relief valve and the accompanying reed valve portion, as they are positioned entirely within the passageway of the pool cleaner. Each valve is capable of receiving the full flow of water under negative pressure from a pool pump.

The relief valve 32 by itself is spring loaded and consists of a valve seat 42 formed into the cage 28 integral with the valve body 20. The seal disc 40 is in linear alignment with the seat 42 and the compression spring 34 urges the disc 40 against the seat. The spring keeper 36 is threaded and holds the spring 34 in compressive tension, which is adjustable by rotating the keeper over a set of threads 44 formed into the valve body 20. While the drawings depict this relief valve 32 in its entirety, the improvement is essentially in the reed valve 22, which may be incorporated into other applications of a pool cleaner with equal ease, anywhere a negative pressure shut-off valve is required whether it is full flow, partial flow, dual passage, or other types. This enhanced reed valve 22 may easily replace other styles of valves, such as hinged jaw or flap valves, flexible diaphragms, bellows, elastomeric jaws, etc., therefore the invention is not in any way limited to the application illustrated and described.

Figure 2:
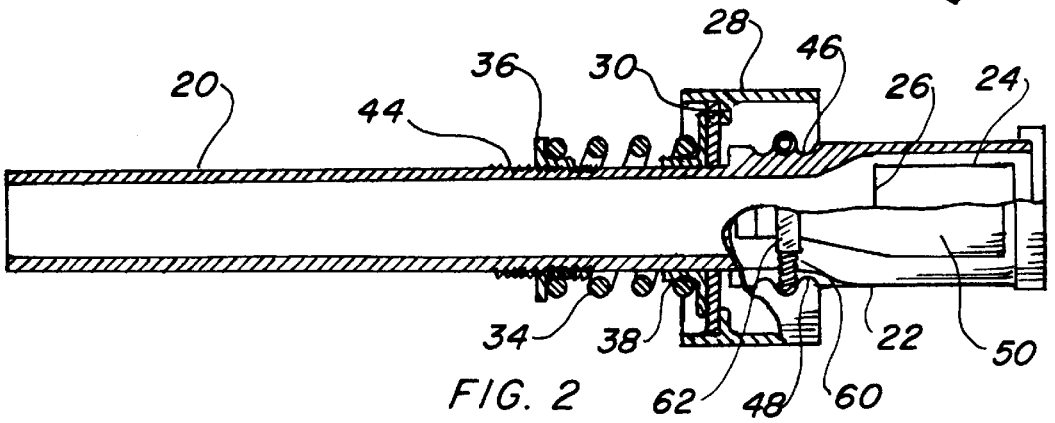
FIG. 2 is a cross-sectional view taken along lines 2—2 of FIG. 1 with the cut-away partially restored illustrating the outside of the valve plate and spring interface.
Figure 3:
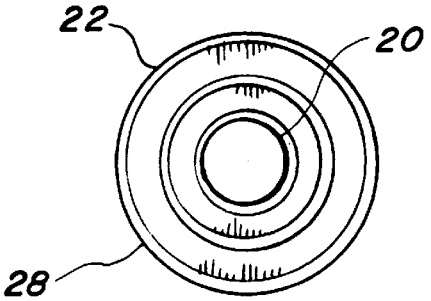
FIG. 3 is a left side view of the preferred embodiment.
Figure 4:
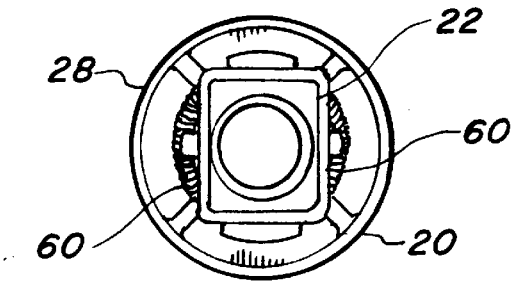
FIG. 4 is a right side view of the preferred embodiment.
Figure 5:
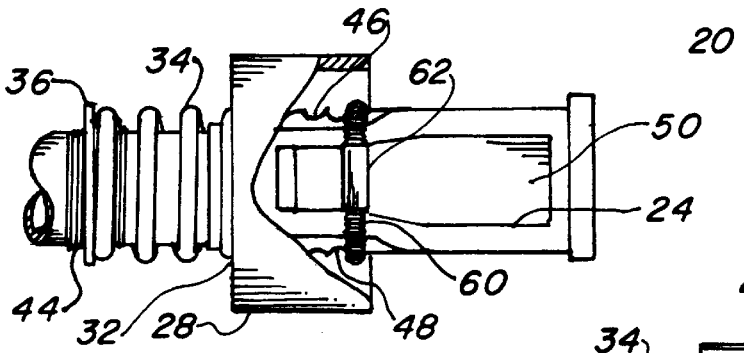
FIG. 5 is a partial front view of the preferred embodiment cut-away to show the garter spring in the front channel groove.
Figure 6:
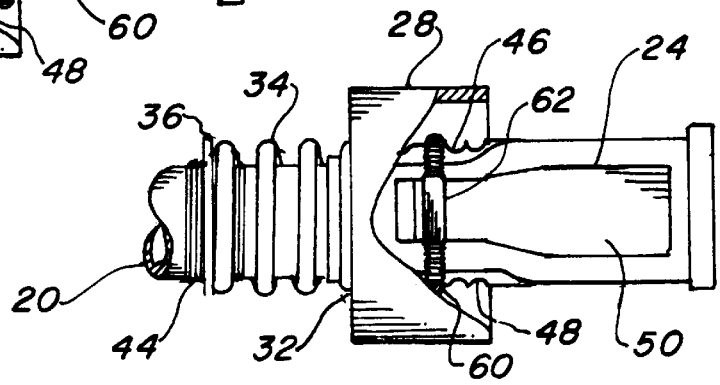
FIG. 6 is a partial front view of the preferred embodiment cut-away to show the garter spring in the rear channel groove.
Figure 7:
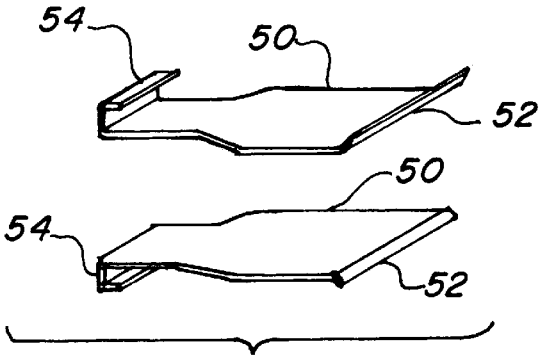
FIG. 7 is a partial isometric view of the opposed pair of reeds.

In any event, the improved reed valve 22, as described, includes a plurality of grooves 46 integrally formed into the body 20, as shown in FIGS. 2, 5 and 6, positioned on sides at right angles and opposite the openings 24 between the rectangular portion and the cage 28. The grooves 46 are in parallel alignment with each other and may have any number of mating channels 48 making up a companion pair with three sets of channels 48 being preferred, as illustrated in FIGS. 2, 5 and 6. A restricting boundary is formed into the cage 28 of the relief valve, however, other methods may be employed to create this restriction in different embodiments, as only a barrier is required. Further, the body is cylindrical in shape with a transition on one end into a rectangular portion in which the rectangular openings 24 are formed one on each opposed side.

Figure 8:
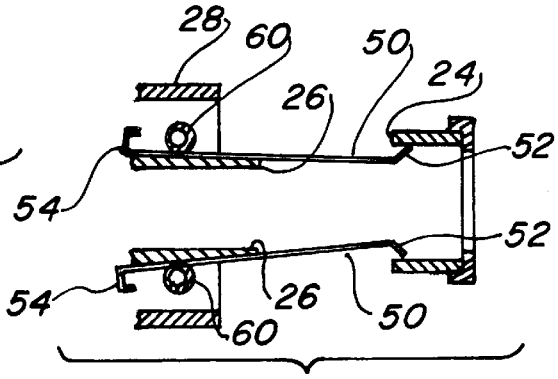
FIG. 8 is a partial front elevational view of the preferred embodiment rotated 90 degrees from FIG. 1 cut-away to show the valve plates at rest.
Figure 9:
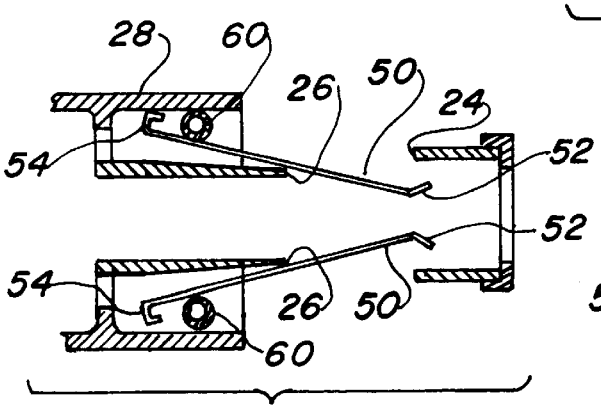
FIG. 9 is a partial front elevational view of the preferred embodiment rotated 90 degrees from FIG. 1 cut-away to show the valve plates closing prior to deflection.
Figure 10:
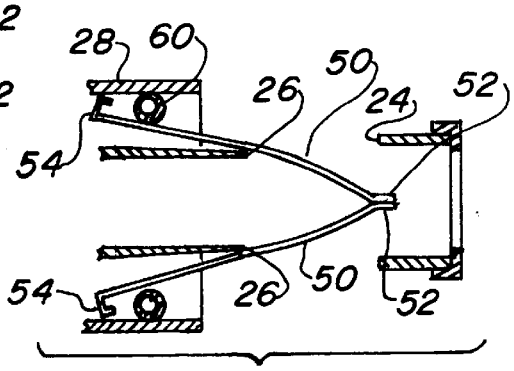
FIG. 10 is a partial front elevational view of the preferred embodiment rotated 90 degrees from FIG. 1 cut-away to show the valve plates deflected in a fully closed position.
Figure 11:
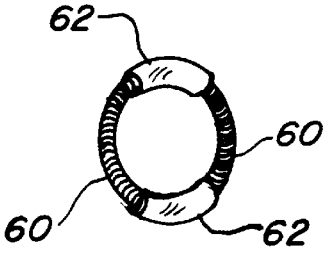
FIG. 11 is a partial isometric view of the garter spring and sleeves completely removed from the invention for clarity.
Figure 12:
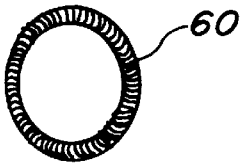
FIG. 12 is a partial isometric view of the garter spring only, completely removed from the invention for clarity.
Figure 13:
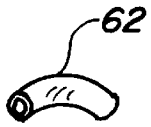
FIG. 13 is a partial isometric view of the garter sleeve completely removed from the invention for clarity.
Figure 14:
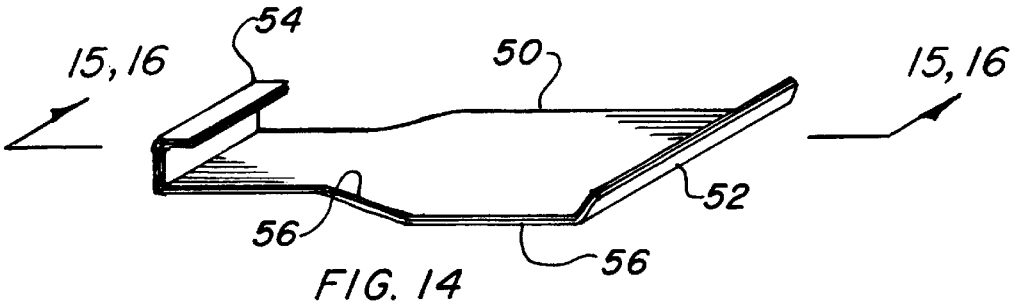
FIG. 14 is a partial isometric view of the reed valve plate completely removed from the invention for clarity.
Figure 15:
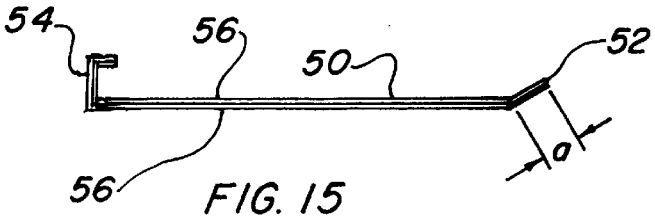
FIG. 15 is a cross-sectional view taken along lines 15—15 of FIG. 14 enlarged to show the laminated valve plate with 2 segments of metal.
Figure 16:
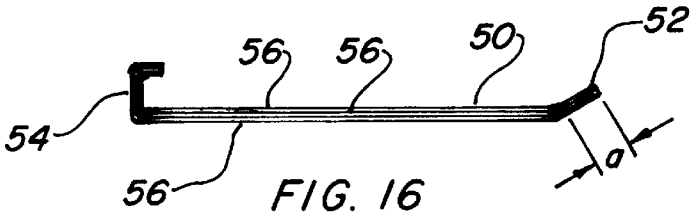
FIG. 16 is a cross-sectional view taken along lines 15—15 of FIG. 14 enlarged to show the laminated valve plate with 3 segments of metal.

A pair of opposed dual acting valve plates 50 are juxtapositioned within the valve body 20 partially on the surface, and the balance positioned into the opening 24, as shown in FIGS. 8 through 10. Each valve plate 50 has a first end that includes an angular outward bend 52 and a second end with inward right angle bend 54, as illustrated in FIGS. 7, 14, 15 and 16. The outward bend 52 has an angle of from 25 to 35 degrees, preferably 30 degrees in the configuration illustrated. While other angles may function equally well, it has been found that this bend is ideal, as both the first ends of each plate 50 mate flush with each other when both plates 50 are simultaneously inwardly deformed by negative fluid pressure applied by an outside source, such as a pool pump in fluid communication with a pool cleaner. The outward bend 52 increases the mating surface area, making the valve closure complete and repeatable without undo stress and strain on the material.

The inward right angle bend 54, in a basic channel shape, is depicted in FIGS. 7 through 10 and 14 through 16 and acts as a stop, limiting the travel of the valves second end when abutted into the restrictive boundary formed by the cage 28. The bend 54 forms an extended surface when the valve plates 50 converge and interface with the inside surface of the hollow cage 28, creating a buffer and distributing the force over a large area, eliminating most wear, as compared to a knife edge individual bend.

The valve plates 50 are made of laminated metal, preferably series 300 stainless steel, however other spring metal may be used and function equally well. Two separate segments 56 have been found to be exemplary having a thickness of from 0.015 to 0.020 inches (0.037 to 0.049 cm), or from 0.010 to 0.015 inches (0.025 to 0.037 cm), with 0.015 inches (0.037 cm) preferred. In either case, the segments 56 are attached together on the first end at the angular outward bend 52. The attachment is basically made with coalescence produced by resistance seam welding or laser fusion, both processes well known in the art. This attachment is made within the area designated "a" in FIGS. 15 and 16, and may completely cover the region or any part thereof, as long as a permanent bond is achieved.

A continuously wound extension garter spring 60 is disposed within a mating pair of channels 48 in the grooves 46 integral with the body 20. This spring 60, depicted by itself in FIGS. 11 and 12, and attached in FIGS. 2, 4, 5, 6 and 8 through 10, surrounds the pair of opposed valve plates 50 adjacent to their second end near the inward right angle bend 54. The spring 60 permits the first end of the valve plate 50, having the angular outward bend 52, to rest against the fulcrum 26 of the body 20 until both the right angle bend 54 of each valve plate and the spring 60 simultaneously engage the restrictive boundary of the cage 28, producing an initial valve action under increased negative fluid pressure. Both valve plates 50 arcuately deform until each outward bend 52 makes intimate contact with each other, closing the valve and impeding fluid flow through the valve, completing the final portion of the dual action. The garter spring 60, preferably includes a resilient sleeve 62 disposed over the spring adjacent to each valve plate 50 for reducing wear and to cushion the impact of the spring as it expands and interfaces with the restrictive boundary of the cage 28. This sleeve 62 may be thermoplastic tubing of any material suitable for the application.

Figure 17:
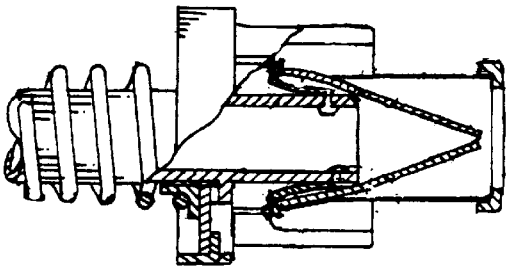
FIG. 17 PRIOR ART
FIG. 17 is a partial cut-away view of the prior art valve with movable and fixed reed deflected into the closed position.
Figure 18:
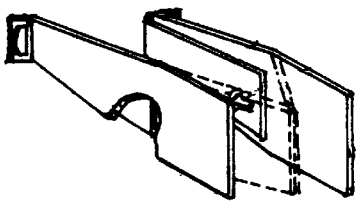
FIG. 18 PRIOR ART
FIG. 18 is a partial isometric view of the prior art movable and fixed valve reeds completely removed from the invention for clarity with the reeds dotted to illustrate the closed position.

FIGS. 17 and 18 illustrate my prior art double acting valves disclosed in U.S. Pat. No. 5,655,246 with FIG. 17 showing a partial view of the left side of the double acting reed valve in the closed position. FIG. 18 depicts a fragmentary exploded partial isometric view of the reed assembly completely removed from the invention for clarity. It may be clearly seen that the improvements in the method of attachment, construction and configuration of the valve is indeed unique and novel by itself.

In operation, each valve plate 50 extends unsupported from the fulcrum to the outward bend 52 on the first end, as depicted in FIG. 8, and when exposed to negative pressure from a pool pump intake, through a flexible hose connected to the pool cleaner, pump suction draws the plates 50 together over the fulcrum, as shown in FIG. 9, creating the first step in a dual action. At this point, the second end of the valve plate 50 with its right angle bend 54 and the garter spring 60 with its protective resilient sleeve 62 engage the restricting boundary of the cage 28, confining any further movement of the valves second end. Pump suction continues until the valve plates 50 flex and curve in a bow shape, forcing the outward bends 52 to contiguously abut, as illustrated in FIG. 10, thereby closing the valve in the final step of the dual action. The flow of water into the pump is blocked, creating a hydraulic shock wave, sometimes referred to as a water hammer.

In the prior art embodiment, the instant the water flow is impeded by the valve plates 50, the integral relief valve 32 sees full negative pressure and is immediately opened, permitting full flow to continue through the valve body 20 flow passageway. Pulsation in the form of the shock wave within the water flow permits the pool cleaner, in which the reed valve is assembled, to move in a random fashion upon submerged bottom and walls of a pool.

Again, it must be emphasized that this valve improvement may be utilized in other similar applications where a reed valve is used. Further, it is unnecessary to be employed in conjunction with a relief valve, as many pool cleaners use separate reed valves for other purposes and combinations.

While the invention has been described in complete detail and pictorially shown in the accompanying drawings, it is not to be limited to such details, since many changes and modifications may be made in the invention without departing from the spirit and scope thereof. Hence, it is described to cover any and all modifications and forms which may come within the language and scope of the appended claims.

What is claimed is:

1. An improved reed valve for a pulsating submersible pool cleaner comprising;

a valve body forming an enclosure having a fulcrum, a plurality of grooves and a restricting boundary for retaining and confining valve movements, a pair of opposed dual acting valve plates juxtaposed within the valve body, each having a first end and a second end, with each first end including an angular outward bend facing away from each opposed plate such that when both plates are simultaneously inwardly deformed by negative fluid pressure applied to the pool cleaner, each outward bend ultimately engages a mating plate for valve closure, and a continuously wound extension garter spring disposed within the grooves in the valve body surrounding the opposed pair of valve plates adjacent to their second end, permitting the first end of each valve plate to contract inwardly against the fulcrum of the body until both the second end of each valve plate and the spring simultaneously engage the restrictive boundary of the body, producing an initial valve action and under increased negative fluid pressure, the valve plates deform until each outward bend makes intimate contact with each other, thereby closing the valve and impeding fluid flow through the valve completing a final and dual action.

2. The reed valve as recited in claim 1 wherein said valve body is thermoplastic.

3. The reed valve as recited in claim 1 wherein said valve body further comprises, a hollow rectangular portion with an opening on each side to receive the valve plates with the fulcrum positioned on one side of each opening, a radial cage integral with the body having a restrictive boundary directly above both the garter spring and the second end of the valve plate for limiting the valve plate movement, also a plurality of opposed grooves formed into the body at right angles to the valve plates between the rectangular portion and the radial cage planar to the opening for retaining and positioning the spring.

4. The reed valve as recited in claim 3 wherein said grooves formed into the body comprise three distinct channels for positioning the spring in alternate locations, depending upon the desired fluid flow through the pool cleaner.

5. The reed valve as recited in claim 1 wherein each valve plate angular outward bend on the first end further comprises an angle of from 25 to 35 degrees.

6. The reed valve as recited in claim 1 wherein said valve plate second end further comprises a pair of inward right angle bends formed into a channel shape for limiting travel and producing an extended surface to interface with the restricting boundary of the valve body.

7. The reed valve as recited in claim 1 wherein said valve plate is laminated metal.

8. The reed valve as recited in claim 7 wherein said valve plate is laminated using two separate segments of metal.

9. The reed valve as recited in claim 8 wherein each laminated valve plate segment has a thickness of from 0.015 to 0.020 inches (0.037 to 0.049 cm).

10. The reed valve as recited in claim 8 wherein each laminated valve plate segment has a thickness of from 0.010 to 0.015 inches (0.025 to 0.037 cm).

11. The reed valve as recited in claim 7 wherein said valve plate is laminated using three separate segments of metal.

12. The reed valve as recited in claim 11 wherein each laminated valve plate segment has a thickness of from 0.010 to 0.013 inches (0.025 to 0.032 cm).

13. The reed valve as recited in claim 11 wherein each laminated valve plate segment has a thickness of from 0.007 to 0.010 inches (0.017 to 0.032 cm).

14. The reed valve as recited in claim 7 wherein the laminated valve plate is fused together at the angular outward bend with coalescence produced by resistance seam welding.

15. The reed valve as recited in claim 7 wherein the laminated valve plate is fused together at the angular outward bend with coalescence produced by laser fusion.

16. The reed valve as recited in claim 1 wherein said valve plate is stainless steel.

17. The reed valve as recited in claim 1 wherein said garter spring further comprises a resilient sleeve disposed over the spring adjacent to each valve plate for reducing wear and to cushion impact of the spring when it expands to interface with the valve body.

18. The reed valve as recited in claim 1 wherein said valve body further comprises a spring loaded relief valve.

19. An improved reed valve for a pulsating submersible pool cleaner comprising;

a thermoplastic valve body forming an enclosure having a fulcrum, a plurality of grooves and a restricting boundary for retaining an confining valve movements, a pair of opposed dual acting laminated valve plates juxtaposed within the valve body, each having a first end and a second end with each first end including an angular outward bend from 25 to 35 degrees facing away from each opposed plate such that when both plates are simultaneously inwardly deformed by negative fluid pressure applied to the pool cleaner, each outward bend ultimately engages a mating plate for valve closure, and a continuously wound extension garter spring disposed within a single pair of grooves in the valve body surrounding the opposed pair of valve plates adjacent to their second end permitting the first end of each valve plate to contract inwardly against the fulcrum of the body until both the second end of each valve plate and the spring simultaneously engage the restrictive boundary of the body, producing an initial valve action and under increased negative fluid pressure the valve plates deform until each outward bend make intimate contact with each other, thereby closing the valve and impeding fluid flow through the valve completing a final and dual action.

* * * * *